US005655670A

United States Patent [19]

Stuart

[11] Patent Number: 5,655,670

[45] Date of Patent: Aug. 12, 1997

[54] CLAMPING BOOKEND

[75] Inventor: Tim S. Stuart, Potomac, Md.

[73] Assignee: Stuart Shelving LLC, Potomac, Md.

[21] Appl. No.: 655,911

[22] Filed: May 31, 1996

[51] Int. Cl.[6] ..... A47F 5/00

[52] U.S. Cl. ..... 211/43; 211/184; 108/61

[58] Field of Search ..... 211/43, 184; 108/60, 108/61

[56] References Cited

U.S. PATENT DOCUMENTS

| | | | |
|---|---|---|---|
| 154,940 | 9/1874 | Adams | 211/184 |
| 305,863 | 9/1884 | Thompson | 108/61 |
| 314,437 | 3/1885 | Crocker . | |
| 355,511 | 1/1887 | Danner | 108/61 |
| 388,674 | 8/1888 | Harrington | 211/43 |
| 431,373 | 7/1890 | Mendenhall . | |
| 436,704 | 9/1890 | Green | 108/61 |
| 452,673 | 5/1891 | Hunter | 108/61 |
| 504,233 | 8/1893 | McVey et al. | 211/43 |
| 607,890 | 7/1898 | Smith | 211/184 |
| 607,891 | 7/1898 | Smith . | |
| 657,847 | 9/1900 | Young . | |
| 668,961 | 2/1901 | Roseboom . | |
| 679,054 | 7/1901 | Kraushaar . | |
| 833,887 | 10/1906 | Maccallum . | |
| 989,566 | 4/1911 | Callaghan . | |
| 1,506,204 | 8/1924 | Snoddy | 211/43 |
| 1,675,269 | 9/1928 | Hine | 108/61 |
| 1,806,642 | 5/1931 | Ohnstrand | 108/61 |
| 1,961,486 | 6/1934 | Hall . | |
| 1,962,967 | 6/1934 | Nathan | 211/184 |
| 2,894,303 | 7/1959 | Armstrong et al. | 211/184 |
| 2,900,086 | 8/1959 | Levy . | |
| 3,121,494 | 2/1964 | Berk | 211/43 |
| 3,285,429 | 11/1966 | Propst | 211/184 |
| 3,347,395 | 10/1967 | Marschak | 211/184 |
| 3,358,956 | 12/1967 | Thornton . | |
| 3,385,450 | 5/1968 | Nadler et al. | 211/42 |
| 3,399,782 | 9/1968 | Bascom | 211/43 |
| 3,501,019 | 3/1970 | Armstrong et al. | 211/184 |
| 3,601,258 | 8/1971 | Stein | 211/184 |
| 3,679,064 | 7/1972 | Howkinson | 211/43 |
| 3,974,918 | 8/1976 | Yaremchuk | 211/43 |
| 4,327,838 | 5/1982 | Cooke | 211/184 |
| 4,395,955 | 8/1983 | Pfeifer | 108/61 |
| 4,768,661 | 9/1988 | Pfeifer | 211/184 |
| 5,103,987 | 4/1992 | Davis | 211/43 |
| 5,161,704 | 11/1992 | Valiulis | 211/184 |
| 5,183,163 | 2/1993 | Slaiken | 211/43 |
| 5,190,166 | 3/1993 | Vilsbøll | 211/43 |
| 5,205,420 | 4/1993 | Petryszak | 211/43 |
| 5,209,357 | 5/1993 | Cannon | 211/43 |
| 5,217,124 | 6/1993 | Stone | 211/184 |
| 5,275,297 | 1/1994 | Dokoupil et al. | 211/184 |
| 5,325,792 | 7/1994 | Mulloy | 108/28 |
| 5,341,945 | 8/1994 | Gibson | 211/184 |
| 5,381,908 | 1/1995 | Hepp | 211/184 |

FOREIGN PATENT DOCUMENTS

| | | | |
|---|---|---|---|
| 109121 | 11/1943 | Sweden | 211/43 |

*Primary Examiner*—Robert W. Gibson, Jr.

[57] ABSTRACT

A clamping bookend which can be securely mounted at selected locations along a shelf includes a body member containing a slot for receiving the shelf, a clamping member pivotally connected with the body member which serves to clamp the bookend to the shelf when pivoted to an upright position, and a stop member or partition connected with the top of the clamping member for retaining objects, such as books, on the shelf. A flex member which serves to increase the clamping force on the shelf as the load applied to the clamping member increases is also disclosed. The flex member is provided at the lower end of the clamping member and extends into the slot receiving the shelf.

10 Claims, 7 Drawing Sheets

CLAMPING BOOKEND

SPECIFICATION

1. Background of the Invention

Books and other articles are often stored or displayed on shelves and the problem of holding and displaying these articles on a shelf is a longstanding problem.

The present invention relates to bookends and, more particularly, to a clamping bookend which can be securely and adjustably mounted on an existing shelf and is capable of withstanding lateral forces resulting from the weight of the books or articles being held.

2. Brief Description of the Prior Art

Various types of bookends, book supports, and binding devices for supporting and displaying books and other objects on shelves are described in the patented prior art. The U.S. patents to Thompson U.S. Pat. No. 305,863, Harrington U.S. Pat. No. 388,674, and Hunter U.S. Pat. No. 452,673, for example, disclose clip-on type partitions and bookends. These clip-on bookends engage the edge of a bookshelf and are generally formed as an integral unit including a base portion, a resilient clip portion, and a book support portion. The resilient clip portion releasably secures the support portion to the bookshelf and the support portion bears against a row of books. The clips for these bookends often extend a great distance along the bottom of the shelf in order to provide structural support and to provide a tight grip on the shelf. The clip, however, is often unsightly and in some cases, significantly protrudes from the underside of the shelf, thus interfering with the use of the space below the shelf. Another drawback of clip-on bookends is that they generally do not provide a strong connection with the shelf and tend to slip, particularly when supporting heavy loads, such as large books.

Individual shelf partitions using a thumb screw or cam are disclosed in the to Smith U.S. Pat. Nos. 607,890 and 607,891. These devices use a clamp arranged under the shelf and a thumb screw or cam which tightens the partition in place by pressing a block against the top of the shelf. The problem with this type of bookend is that the locking arrangements are overly complicated and unsightly and the thumb screws tend to loosen over time.

The present invention was developed in order to overcome these and other drawbacks of the prior devices by providing an improved clamping bookend which can be easily mounted on and removed from existing shelves, requires a minimum of shelf space, and does not interfere with the use of the space beneath the shelf. The bookend may be mounted and removed without damaging the shelf or the objects held or displayed, is attractive and suitable for use in homes, offices, or public areas of a store, may be used as a shelf divider or to secure binning and banding partitions to each other in an upright position on the shelf, and can be securely mounted on a shelf to support and display heavy objects.

SUMMARY OF THE INVENTION

Accordingly, it is a primary object of the present invention to provide a bookend which can be firmly clamped to a shelf at a selected location. It is a more specific object of the invention to provide a clamping bookend having a body member containing a slot for receiving the shelf and a clamping member pivotally connected with the body member for movement between a lower disengaged position and a raised clamped position, whereby when the clamping member is pivoted from the lower disengaged position to the upright clamping position, the bookend is firmly clamped to the shelf.

It is another object of the invention to provide a clamping bookend having a stop member, partition, or binding connected with the clamping member which serves to retain or divide items arranged on the shelf.

It is a further object of the invention to provide a clamping bookend wherein the body member has a C-shaped configuration and includes a pair of generally parallel spaced leg portions and a connecting portion defining a slot which is adapted to receive the shelf.

It is yet another object of the invention to provide a clamping bookend having a latching mechanism connected with the top of the body member which serves to releasably lock the clamping member in its upright or clamping position.

It is a still further object of the invention to provide a clamping bookend having a flex portion connected with the lower end of the clamping member which wedges against the shelf and transmits a horizontal load applied to the clamping member to the shelf, thereby increasing the clamping force as the load increases.

It is another object of the invention to provide a one-piece clamping bookend. The one-piece bookend is formed of self-hinging, synthetic plastic material and includes a body portion and a book-retaining portion pivotable between a lowered, disengaged, or open position and an operative upright position.

It is another object of the invention to provide a clamping bookend in which the clamping member and the body member are formed as separate components, thereby allowing these parts to be interchanged to suit specific installations.

It is another object of the present invention to provide a clamping bookend which is easily and inexpensively manufactured, durable, and easy to operate.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
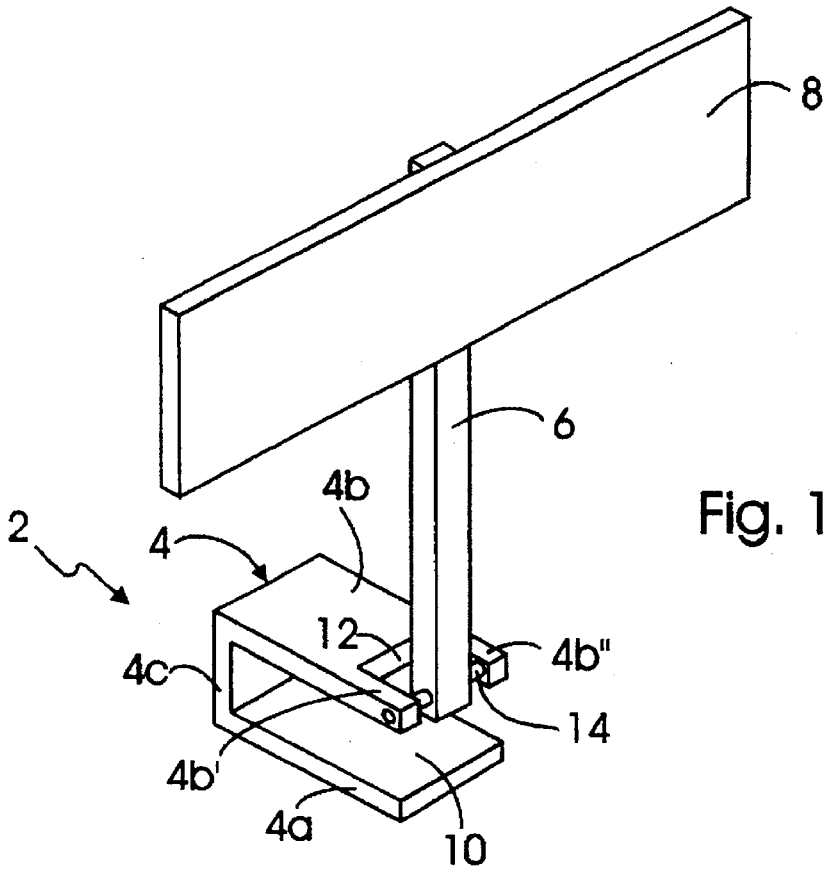
FIG. 1 is a front perspective view of a clamping bookend according to the invention.

Referring first to FIG. 1, there is shown a clamping-type bookend 2 having a body member 4, a clamping member 6, and a stop member 8. The body member, clamping member, and stop member are formed of a strong durable material such as, for example, wood, metal, or plastic. The body member 4 includes a lower leg portion 4*a*, an upper leg portion 4*b* which is generally parallel to leg portion 4*a*, and a connecting portion 4*c*. Leg portions 4*a*, 4*b* and connecting portion 4*c* define a slot 10 which receives a shelf (not shown) therein. Upper leg portion 4*b* includes a pair of arms 4*b*' and 4*b*" defining a cut-out 12 within which the clamping member 6 is connected with the upper leg portion 4*b* via a pivot pin 14. Stop member 8 is connected with the upper end of the clamping member 6 generally perpendicular to the length of the body member 4. With the stop member arranged in this manner, the bookend is ideally suited for placement on the side of a shelf, whereby stop member 8 abuts the side of a book or other object on the shelf.

Figure 2:
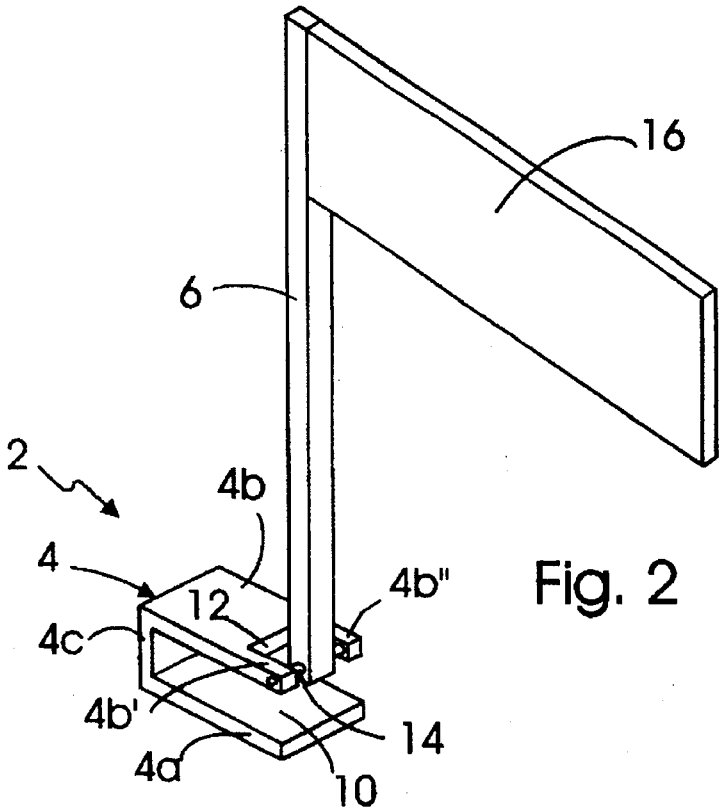
FIG. 2 is a front perspective view of a clamping bookend having a partition on the upper end of the clamping member.

The bookend shown in FIG. 2 is similar to the bookend of FIG. 1 except that a partitioning divider 16 is provided on the upper end of the clamping member 6 in place of the stop member 8. This bookend is best suited for placement along the from of a shelf, whereby the divider extends across the length of the shelf. Such an arrangement is necessary, for example, with a bookcase having side walls which prevent placement of the bookend on the ends of the shelf.

Figure 3:
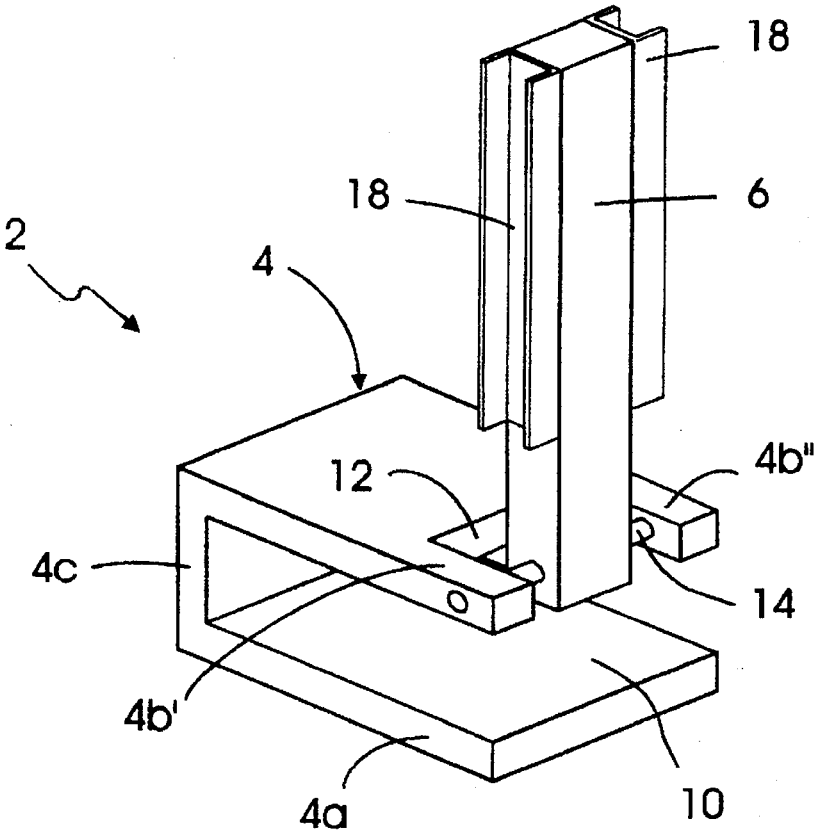
FIG. 3 is a front perspective view of a clamping bookend having binding connected with the upper end of the clamping member.

FIG. 3 is also similar to FIG. 1 except that binding 18 is provided at the upper end of the clamping member 6. The binding receives banding and/or binning (not shown) which is placed in the binding after installation of the body member and clamping member and serves to holds the banding and/or binning in an upright position relative to the shelf along the front or sides thereof.

Figure 4:
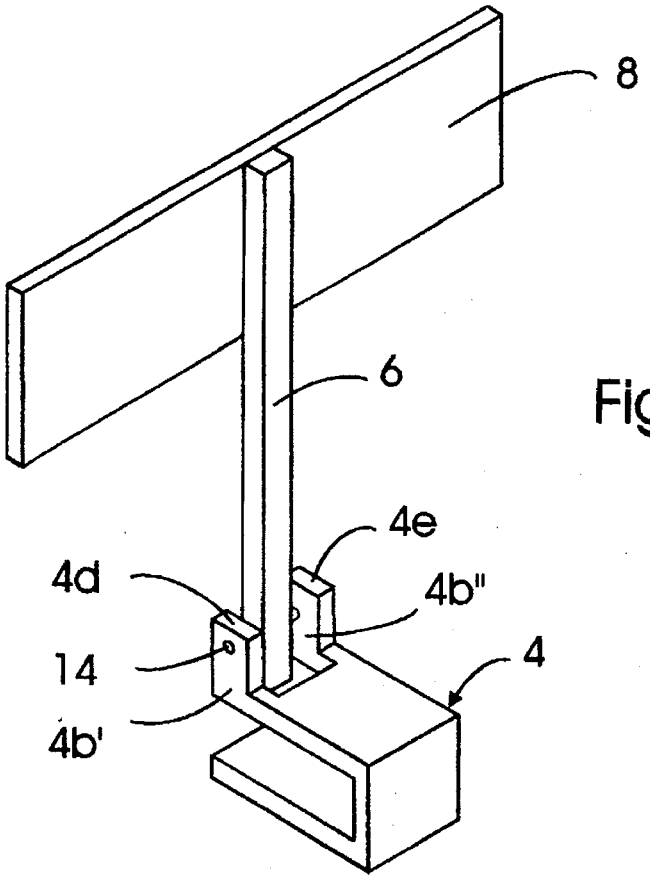
FIG. 4 is a rear perspective view of a clamping bookend having raised portions for receiving the pivot pin.
Figure 5:
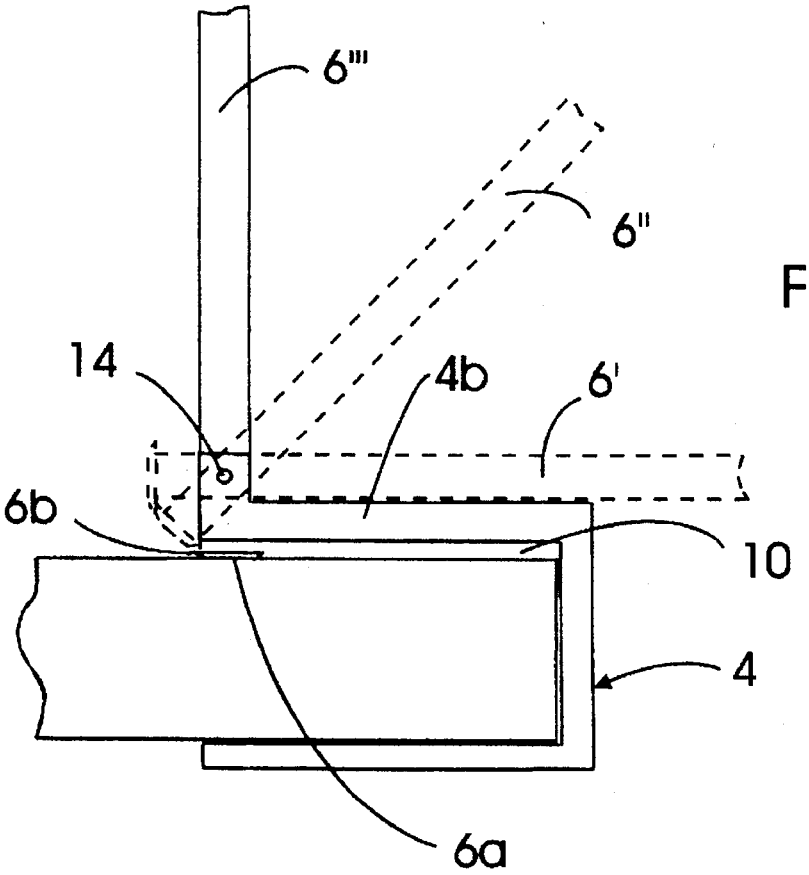
FIG. 5 is a side view of a clamping bookend showing the operation of the clamping member.

FIG. 4 is similar to FIG. 1 except that body member 4 includes a pair of raised portions 4*d* and 4*e* which extend upwardly from arm portions 4*b*' and 4*b*", respectively, and which receive the ends of the pivot pin 14. The operation of each of the bookends shown in FIGS. 1–4 is the same and will now be described with reference to FIG. 5. With the clamping member in the lowered, disengaged, or opened position 6' shown in phantom, where the clamping member is parallel to leg portions 4*a* and 4*b*, the body member 4 is placed on a shelf 22. The body member is sized such that slot 10 is slightly larger than the thickness of the shelf and the shelf fits loosely within the slot. Once placed on the shelf, the clamping member is raised by hand to an intermediate position 6", whereby the lower end 6*a* of the clamping member extends into slot 10 and engages the upper surface of the shelf 22, thereby wedging the shelf between the lower end of the clamping member and the lower leg portion 4*a* of the body member. To facilitate installation, the lower end of the clamping member is provided with bevelled edges 6*b*. As the clamping member is raised to its fully upright or raised position 6"', the body member 4 is pulled toward the shelf 22, thus forming a tight fit between the edge of the shelf and the body member and securely clamping the bookend to the shelf at a selected location.

The clamping force generated by the clamping member is sufficient to firmly maintain the bookend on the shelf without marring or otherwise damaging the shelf. It will be recognized that the clamping force can be varied to avoid damaging the shelf by changing the length or rigidity of the lower end portion 6*a* of the clamping member. In addition, the clamping force can be increased by increasing the roughness of the clamping member surface which engages the shelf or by placing shims or pads between the clamping member end portion 6*a* and the shelf 22 or between the lower leg portion 4*a* of the body member and the shelf.

It will be recognized that the bookend may also be used in an inverted position, if desired, to serve as a partition or bookend for books or objects on a surface, such as another shelf, located beneath the shelf on which the bookend is mounted.

Figure 6:
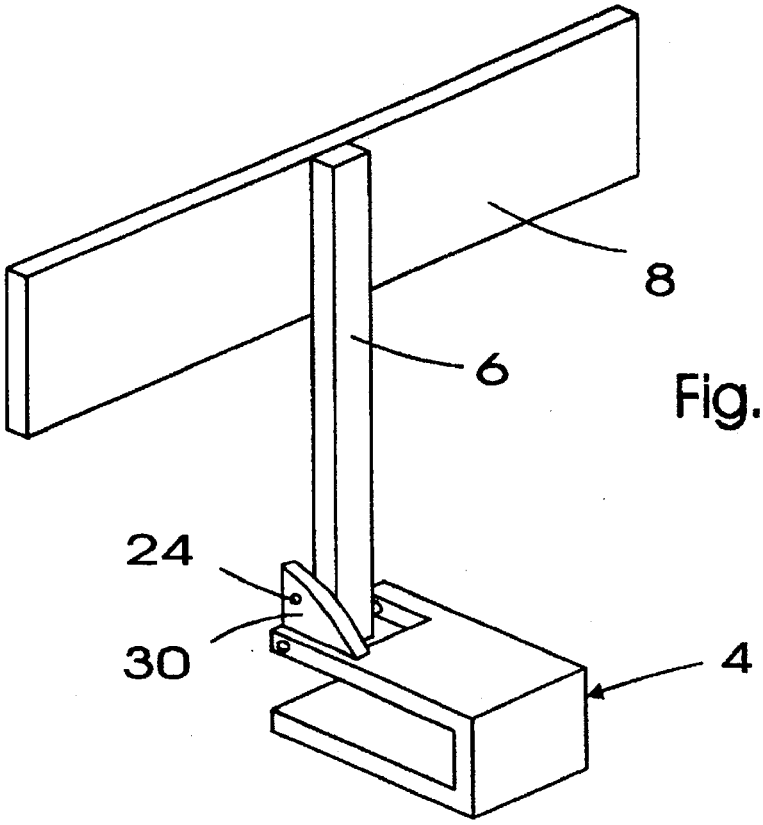
FIG. 6 is a rear perspective view of a clamping bookend having a latching mechanism.
Figure 7:
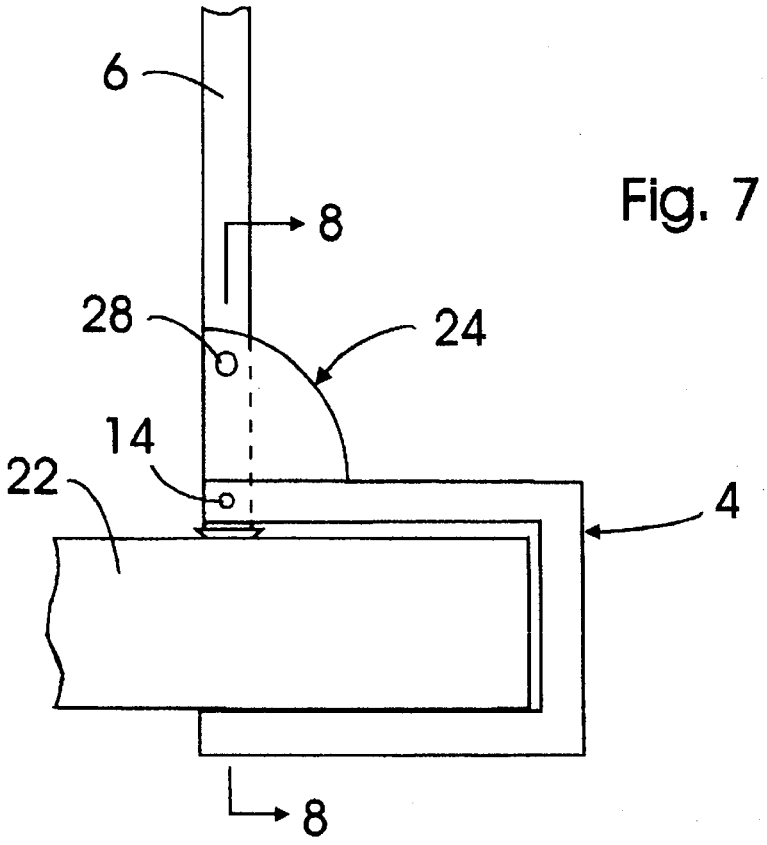
FIG. 7 a side view of the clamping bookend of FIG. 6.
Figure 8:
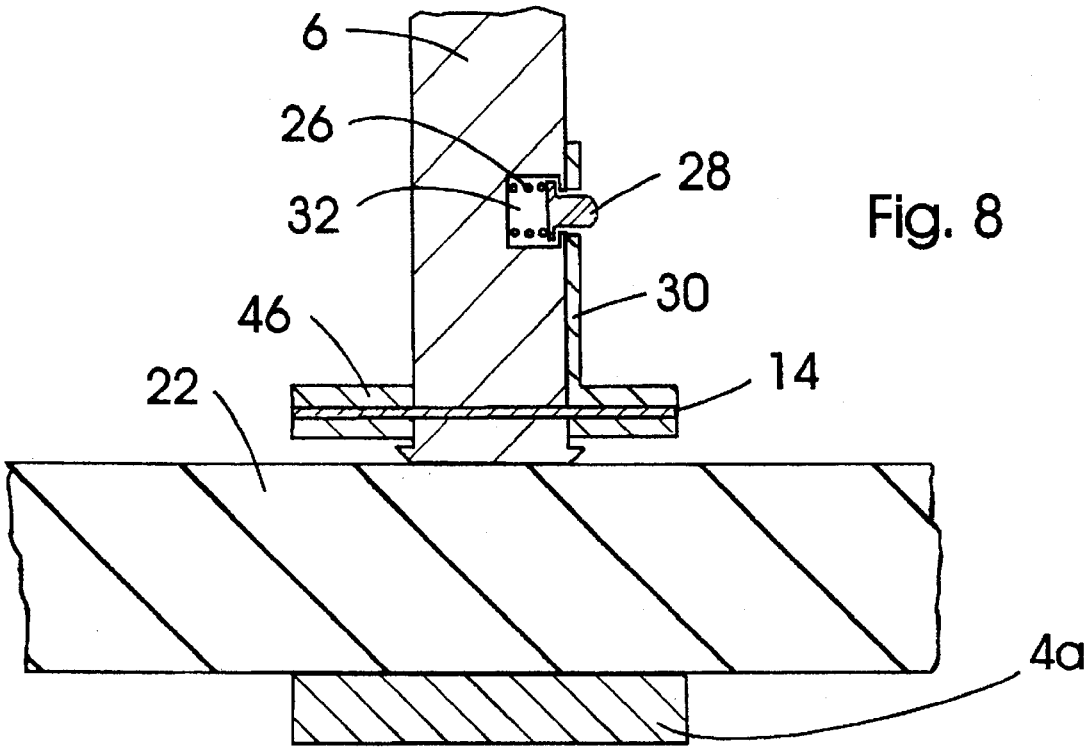
FIG. 8 is a cross-sectional view taken along line 8—8 of FIG. 7.

Referring now to FIGS. 6–8, there is shown a bookend having a latch mechanism 24 which serves to lock the clamping member 6 in its upright or raised position. As shown in FIG. 8, the latch mechanism 24 includes a spring 26, a button 28, and a radius plate 30. Clamping member 6 contains a recess 32 for receiving the spring 26 which is a conventional helical spring. The button 28 abuts spring 26 and is normally biased outwardly in the direction of the radius plate 30. The radius plate is rigidly connected with the upper leg portion 4*a* of the body member and contains a hole 34 arranged to receive the button 28 when in alignment therewith. Accordingly, as the clamping member 6 is raised to its fully upright or clamped position, button 28 and hole 34 become aligned, whereby the button is biased outwardly through the hole, thereby locking the clamping member in the upright position. To release the clamping member, button 28 is manually pressed inwardly to compress the spring 26 until the button clears the radius plate 30, thereby allowing the clamping member to be lowered.

Figure 9:
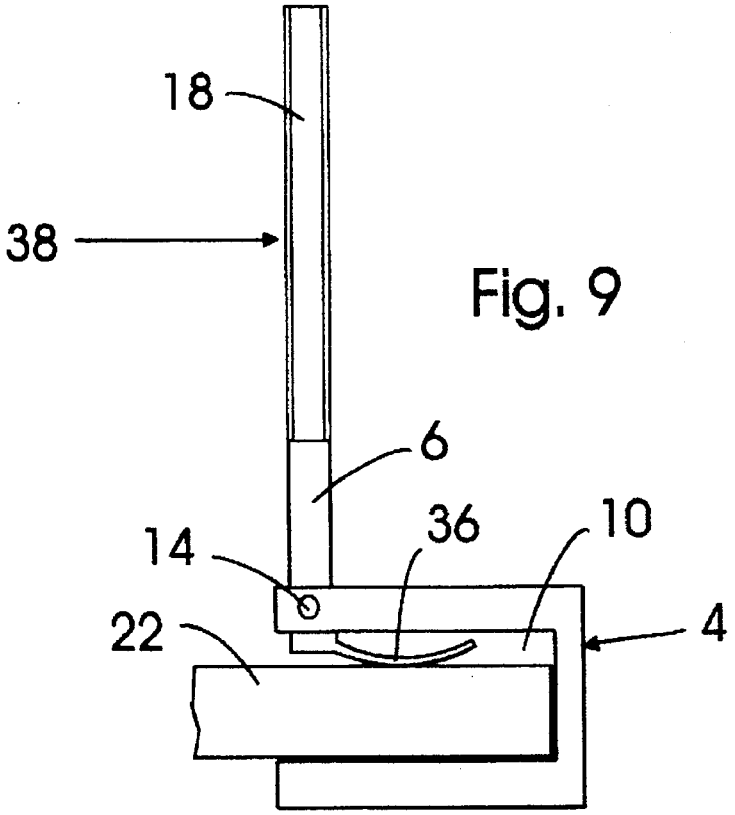
FIG. 9 is a side view of a clamping bookend having a flex portion at the lower end of the clamping member.

FIG. 9 shows a bookend with a clamping member 6 having a flex member 36 on its lower end. Flex member 36 is formed as an integral part of clamping member 6 but may also be a separate component connected with the clamping member. When the clamping member 6 is in its lowered position, flex member 36 extends across slot 10. As the bookend is placed on the shelf 22, the clamping member rises to its upright position. Once the bookend has been installed on the shelf, flex member 36 serves to transmit a load, represented by arrow 38, applied to the clamping member 6 to the shelf 22 via pivot pin 14. Thus, the greater the horizontal load applied to the clamping member, the greater the clamping force applied to the shelf, and the greater the clamping force applied to the shelf, the less likely the bookend will slide off of the shelf.

Figure 10:
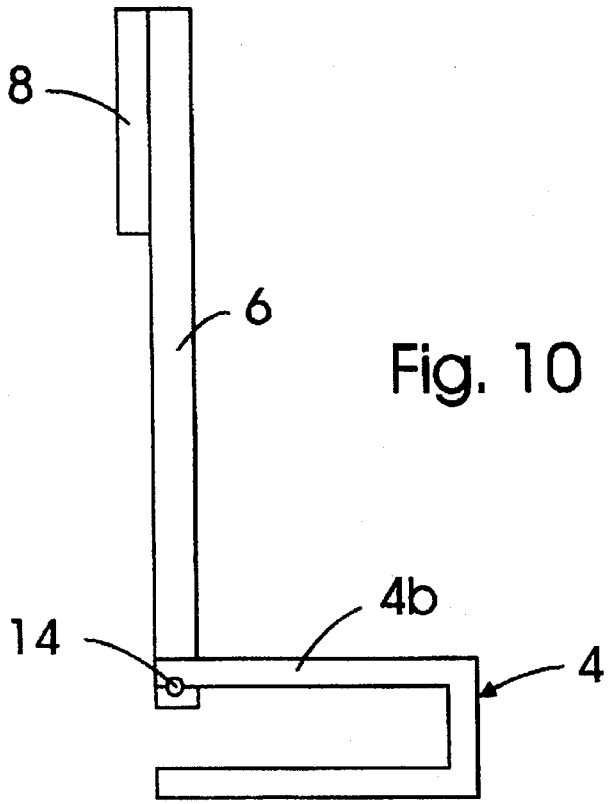
FIG. 10 is a side view of a clamping bookend in which the clamping member and body member are formed as two separate components.
Figure 11:
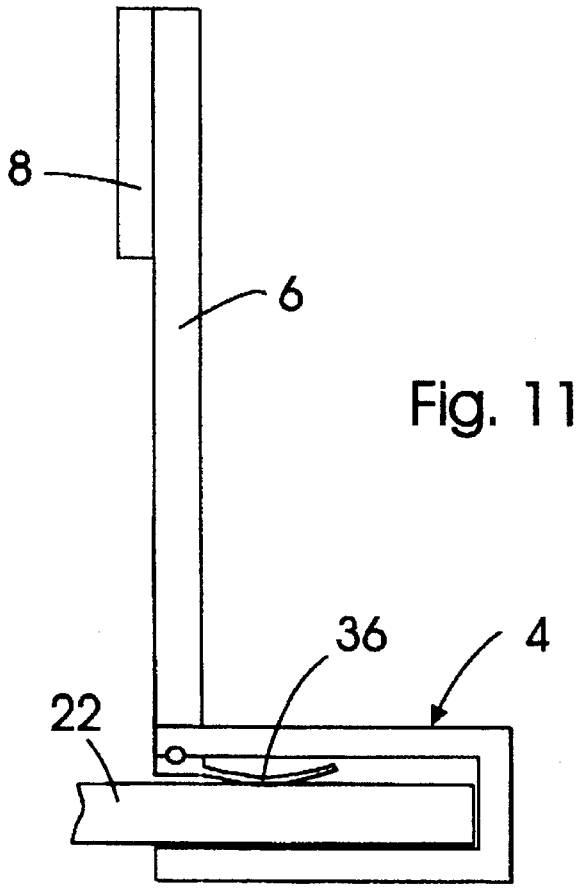
FIG. 11 is a side view of a clamping bookend having a flex portion at the lower end of the clamping member, with the clamping member and the body member being formed as two separate components.

FIGS. 10 and 11 show a bookend in which the clamping member 6 and the body member 4 are separable. The bookend on FIG. 11 includes a flex member 36 as described above. In order for clamping member 6 and body member 4 to be separable, pivot pin 14 is located in slot 10 and abuts upper leg portion 4*b* rather than passing through the upper leg portion. Having separable body member and clamping components allows a standardized body member 4 to be easily and inexpensively manufactured and different clamping members to be used interchangeably with the standardized body member. Each clamping member includes a pivot pin and is provided with a stop member, partition, or binding as previously described. Having standardized components of simple construction which can be easily combined to meet different needs provides additional flexibility for shipping, storage, packaging, and display. In addition, this approach allows consumers to "mix and match" components as required by a specific installation.

Figure 12:
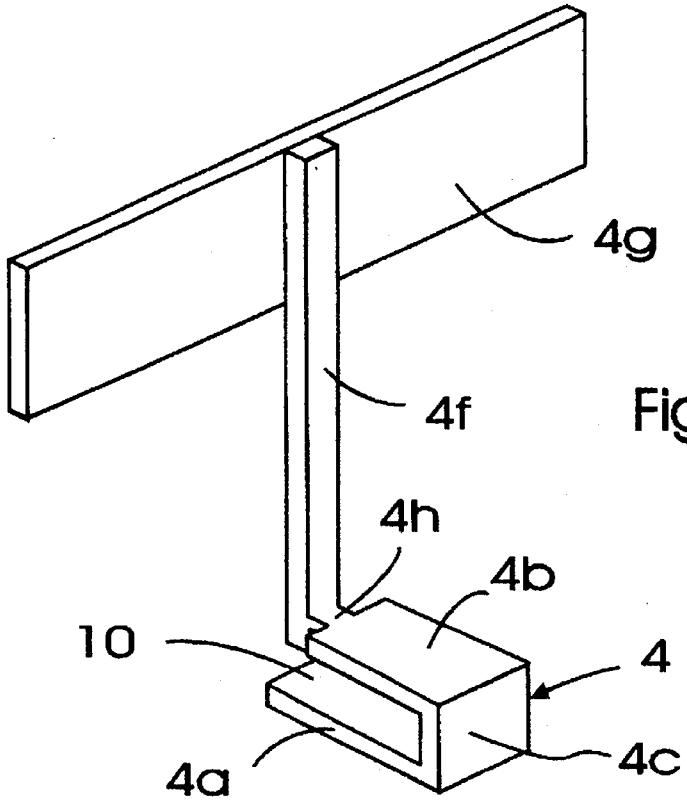
FIG. 12 is a rear perspective view of a one-piece integral clamping bookend.
Figure 13:
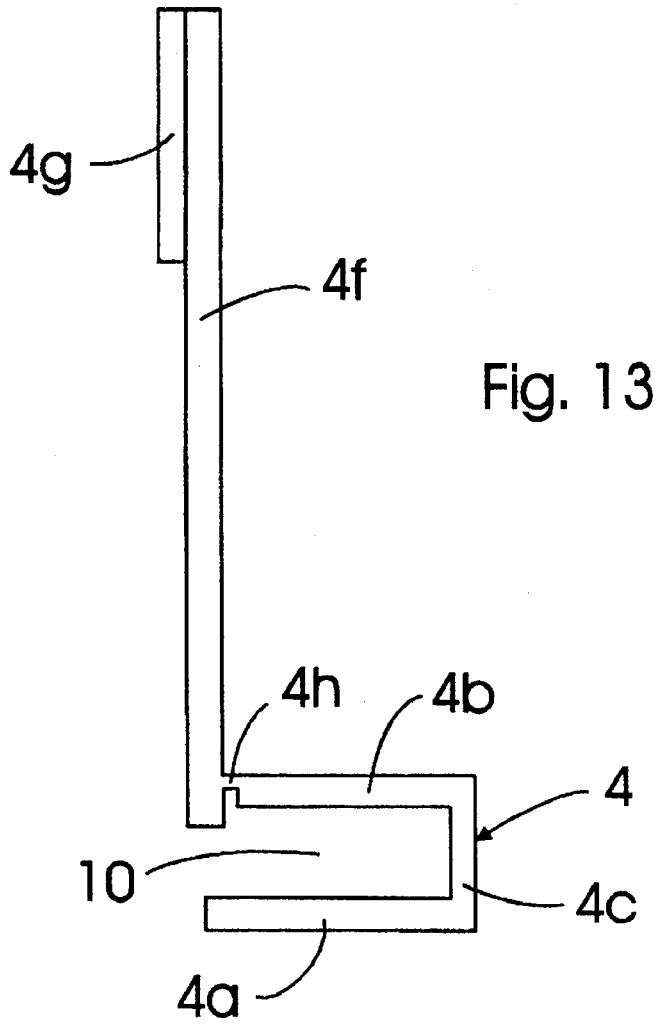
FIG. 13 is a side view of the clamping bookend of FIG. 12.

The bookend shown in FIGS. 12 and 13 is similar to the bookend of FIG. 1 except that it is a one-piece integral bookend formed of a molded, self-hinging synthetic plastic material such as, for example, polypropylene. The body 4, clamping portion **4*f*, and stop portion 4*g* are formed of one piece of molded plastic material and the upper leg portion 4*b* is connected to the clamping portion 4*f* via a thin web or hinge 4*h*. By utilizing a self-hinging plastic such as polypropylene, the thin web 4*h* serves as an integral hinge which permits pivotable movement of the clamping portion 4*f* relative to the upper leg portion 4*b*** between a lowered, disengaged or open position and an operative upright position.

Figure 14:
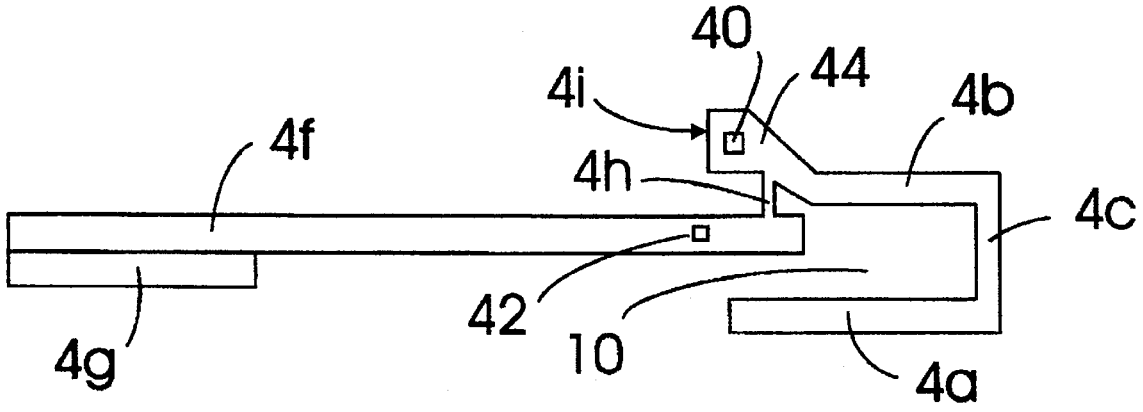
FIG. 14 is a side view of the clamping bookend of FIG. 12 having a latching mechanism.

The bookend shown in FIG. 14 is similar to the bookend shown in FIGS. 12 and 13 with the addition of a latch portion **4*i* containing a latch opening 40 which serves to reversibly lock the clamping portion 4*f* in its upright or raised position. As the clamping portion 4*f* is raised, a nib 42 protruding from clamping portion 4*f* engages a latching plate 44 and, as the clamping portion 4*f* is pivoted further toward the upright position, the opening 40 in plate 44. The edge of the latching plate 44 toward the clamping portion 4*f* is sloped to allow the nib 42 to easily ride under the latching plate 44, while the opening 40 in the latching plate is not sloped, thus securely holding the nib 42 in the opening 40 and holding the clamping portion 4*f* in the upright or raised position. The latch is released by moving, by hand, the opening 40 in the plate 44 away from the clamping portion 4*f*, thus disengaging the nib 42 from the opening 40** and allowing the pivoting of the clamping member to the open position.

While in accordance with the provisions of the Patent Statutes the preferred forms and embodiments of the invention have been illustrated and described, it will be apparent to those of ordinary skill in the art that various changes and modifications may be made without deviating from the inventive concept set forth above.

What is claimed is:

1. A bookend which can be securely mounted along a shelf, comprising:

(a) a body member containing a slot for receiving the shelf; and (b) at least one clamping member pivotally connected with said body member for movement between a lowered disengaged position and a raised clamping position, said clamping member including an upper portion for abutting against a book and a lower portion extending into said slot when said member is in the raised position, said clamping member lower portion wedging against the shelf within said slot as said clamping member is pivoted to the raised position to securely clamp said body member to the shelf at a selected position thereon.

2. A bookend as defined in claim 1, wherein said upper portion includes abutment means for retaining items on the shelf.

3. A bookend as defined in claim 2, wherein said upper portion includes binding adapted to receive at least one partition.

4. A bookend as defined in claim 3, wherein said body member has a C-shaped configuration and includes a pair of generally parallel spaced leg portions and a connecting portion defining said slot, and further wherein said clamping member is connected with one of said leg portions.

5. A bookend as defined in claim 4, wherein said clamping member upper portion is generally perpendicular to said body member leg portions when said clamping member is in the raised position.

6. A bookend as defined in claim 5, wherein one of said leg portions includes a raised portion containing a hinge, said clamping member being connected with said body member via said hinge.

7. A bookend as defined in claim 6, and further comprising latching means connected with said clamping member for retaining said clamping member in the raised position.

8. A bookend as defined in claim 1, wherein said clamping member lower portion comprises a flex portion which wedges against the shelf when said clamping member is in the raised position.

9. A bookend as defined in claim 8, wherein said flex portion extends inwardly with respect to said slot and generally normal to a longitudinal axis of said clamping member, whereby the clamping force generated by the clamping member on the shelf increases as said clamping member pivots beyond the raised position.

10. A one-piece bookend which can be securely mounted along a shelf, comprising:

(a) a body portion containing a slot for receiving the shelf, said body portion having a C-shaped configuration and including a pair of generally parallel spaced legs and a connecting portion defining said slot;

(b) at least one flexible hinge portion extending from one of said legs; and (c) at least one clamping portion extending from said hinge portion for movement between a lowered disengaged position and a raised clamping position, said clamping portion including an upper portion for abutting against a book and a lower portion extending into said slot when said clamping portion is in the raised position, said clamping portion lower portion wedging against the shelf within said slot as said clamping portion is pivoted to the raised position to securely clamp said body portion to the shelf at a selected position thereon.

* * * * *